United States Patent [19]

Ray

[11] 4,373,721

[45] Feb. 15, 1983

[54] RACKET STRINGER TENSIONER

[76] Inventor: Lynn L. Ray, P.O. Box 3464, San Diego, Calif. 92103

[21] Appl. No.: 238,890

[22] Filed: Feb. 27, 1981

[51] Int. Cl.[3] ..... A63B 51/00

[52] U.S. Cl. ..... 273/73 A; 254/213

[58] Field of Search ..... 273/73 A, 73 B; 242/74, 242/125.1; 254/199, 213–217, 251

[56] References Cited

U.S. PATENT DOCUMENTS

| | | | |
|---|---|---|---|
| 1,916,699 | 7/1933 | Tauber et al. | 273/73 A |
| 2,051,059 | 8/1936 | Rostron et al. | 273/73 A X |
| 2,069,736 | 2/1937 | Roberts | 273/73 A |
| 2,971,760 | 2/1961 | Boykin et al. | 273/73 A |
| 3,302,950 | 2/1967 | Hartman | 273/73 A |

FOREIGN PATENT DOCUMENTS

| | | | |
|---|---|---|---|
| 528985 | 11/1940 | United Kingdom | 273/73 A |
| 2014458 | 8/1979 | United Kingdom | 273/73 A |

*Primary Examiner*—Anton O. Oechsle

*Attorney, Agent, or Firm*—Charmasson, Branscomb & Holz

[57] ABSTRACT

A racket stringer tensioner is provided for use on a typical racket holding frame whereby the string being tensioned can be easily looped around and passed between the two separate portions of a split drum which compresses to pinch the string when it is tightened, tightening being accomplished by the force exerted by a weighted torque arm expressed to the split drum through a one-way mechanism which permits a ratcheting-type action to advance the string further in the string gripper if necessary, so that in the event the string is not advanced far enough in the split drum string gripper, a quick ratcheting action tightens the string while maintaining the weighted torque arm substantially in horizontal position, which is required to insure the accuracy of the weight setting.

3 Claims, 5 Drawing Figures

RACKET STRINGER TENSIONER

BACKGROUND OF THE INVENTION

A variety of tennis racket stringers of the simpler type utilize a racket gripping frame with a string tensioner comprising basically a small rotable drum with an extended torque arm having a variably positioned weight on it so that when the string is engaged around the drum, with the weight positioned to the proper tension setting, when the weight is released proper tension is achieved.

There are a couple of problems with this device. First, the string must be wrapped several times around the frictional drum to insure that it dosen't slip. This takes additional time as opposed to a single wrapping, as the string must be tensioned a number of separate times representing each crossing of the racket face.

Aside from the means of engaging the string to be tensioned the traditional racket stringer must maintain the weight bar substantially in the horizontal position throughout the tensioning process to insure that the moment arm experienced by the string wrapping drum does not vary. Although a prior art device exists which utilizes a ratchet-type action to permit adjusting the weight arm subsequent to wrapping the string around the drum, because there is no means of positively engaging the string on the drum, it is still subject to slippage and to a certain extent negates the advantage achieved by the incorporation of the ratcheting mechanism.

SUMMARY OF THE INVENTION

The present invention resolves the above stated problem by incorporating in a single unit a positive-grip string engaging drum coupled with the one way ratchet-type action required to insure the weight arm extends in a generally uniform, substantially horizontal position throughout the tensioning of the string.

This is accomplished by the mounting of the drive drum which supports the weight arm co-axially with a carrier, also rotational, which mounts a split drum utilized to positively engage a racket string. The carrier and the drive drum are mutually uni-directionally rotationally linked, so that movement of the weight in the direction which tensions the string positively drives the split drum, but manually lifting the weight while maintaining the split drum stationary with the other hand permits a free-wheeling rotational adjustment to take place between the carrier and the drive drum.

The split drum itself includes one portion which is fixed on the face of the split drum carrier, and another portion which is preferably pivoted at one end so that when encircled by a string wrapped around the drum prior to its passing through the corridor defined between the split drum portions, compression constricts the two portions, securely pinching the string therebetween. A suitable frictional coating is applied around both drum portions, and a V-shaped entryway is also established into one side of the corridor for ease of threading.

DETAILED DESCRIPTION OF THE PREFERRED EMBODIMENT

Figure 1:
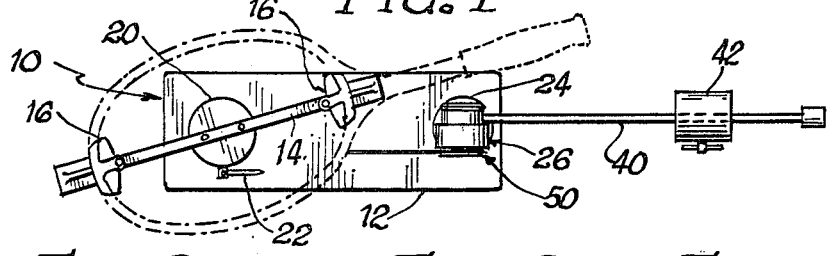
FIG. 1 is a plan view of a complete racket stringing device.

In FIG. 1 a racket stringer is shown at 10 having a frame which includes a planar base 12 which rotatably mounts crossbar 14 having clamps 16 which engage the racket rim 18 of a racket that needs stringing. The crossbar 14 rotates about a vertical axis on the post 20 which has a means for making same nonrotational operated by a lever arm 22.

At the other end of the base 12 is an upright support 24 which supports the string tightener generally indicated at 26 on an axis-defining stub 28 to which a retainer collar 30 is secured with a bolt 32.

Adjacent the endcap 34 of the upright support is a rotational member 36 which includes a drum 38 which is used to drive the string gripper. Weight rod 40 extends from this member 36 and mounts longitudinally adjustable weight 42. The weight rod 40 is graduated to indicate different tensions that might be desired in the strings of the racket.

Rather than a direct drive between the drive drum 38 and the string engaging structure, a split drum carrier 44 is engaged on the axis 28 and retained by collar 30 in journaled relation to the drum 38 except that a one-way mechanism is incorporated between the carrier and the drum, in the illustration being in the form of a spring 46. This spring has one anchor arm 48 which engages in the carrier, with the remaining portion of the spring encircling the drive drum so that when the weight arm moves under the action of the weight, it tends to tighten the spring thus causing the spring to securely grip the drum, but when the weight is lifted, the spring is loosened so that the carrier 44 can be held with one hand while the weight bar is moved upwardly, to adjust the angular position of the weight bar relative to the horizontal.

Figure 2:
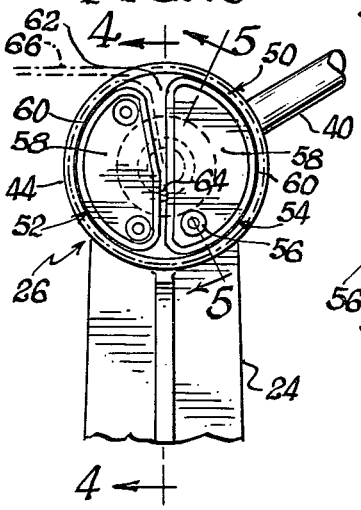
FIG. 2 is a detail showing the face of the split drum.
Figure 3:
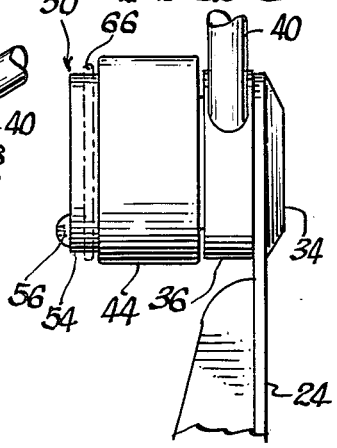
FIG. 3 is a detail of the tightening mechanism seen from the end.
Figure 4:
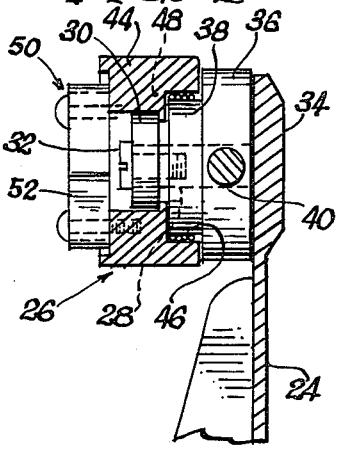
FIG. 4 is a section taken along line 4—4 of FIG. 2.
Figure 5:
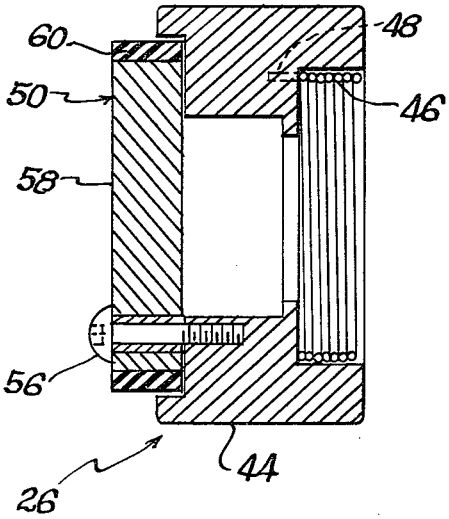
FIG. 5 is a section taken along line 5—5 of FIG. 2.

The carrier 44 carries split drum 50 which has one portion 52 which is fixed, and another portion 54 which pivots at 56. Both of these drum portions comprise an inner rigid core 58 covered with a frictional gripping surface 60, and together they define a V-shaped entry groove 62 into the corridor 64. As can be seen in FIG. 2, drum 50 is substantially circular in cross-section and corridor 64 generally follows a chord across a cross-section of drum 50.

In use, a string indicated in phantom at 66 encircles the split drum 50 and passes through the corridor 64 as shown in FIG. 2. Due to the frictional surface 60, the string is sufficiently engaged that when the weight 42 is in use, the string is not pulled free of the corridor but rather compresses the two portions of the split drum together increasingly pinching the string therebetween.

Because of the ratchet-type action of the spring 46, if the string is wrapped and threaded as shown in FIG. 2 but the result is that the weight bar 40 falls significantly below the horizontal, thus affecting its moment arm, it can be "ratcheted" back up to the horizontal position, or just above the horizontal, by holding the split drum carrier 44 with one hand and raising the weight with another, freewheeling the two members in reverse.

By utilization of the combination ratchet-type weight arm mount and the quick-release positive action split drum string retainer, a racket can be strung not only more quickly, but with more uniform tension than with any other stringing machine at the same basic price level and of the same basic degree of complexity.

While I have described the preferred embodiment of the invention, other embodiments may be devised and different uses may be achieved without departing from the spirit and scope of the appended claims.

What is claimed is:

1. In a racket stringer having a frame for holding a racket and a string tensioner support mounted to said frame, a string tensioner comprising:

(a) a split drum and means mounting same to said support rotationally to define a rotational axis generally perpendicular to the direction of a string extended from said racket;

(b) said split drum defining two drum portions having a corridor therebetween and being mutually compressible under the action of a string wrapped therearound to pinch a string extended through said corridor;

(c) said drum being substantially circular in cross-section and said corridor generally following a chord across a cross-section of said drum;

(d) a member mounted to said support for releasably applying a rotational force to said drum mounting means about its axis such that a string drawn from a racket around said drum and through said corridor is gripped by said drum portions and tensioned by the force exerted by said member; and (e) said means mounting said drum portions comprising a carrier rotationally mounted to said support, and one of said drum portions being fixed on said carrier and the other being moveably mounted thereto to be compressible against the drum portion fixed on said carrier to pinch a string extended through said corridor.

2. Structure according to claim 1 wherein the other of said drum portions is pivoted to said carrier at one end thereof.

3. Structure according to claim 1 wherein said drum portions are each defined of a rigid core with a frictional external covering.

* * * * *